US005651668A

United States Patent [19]

Schmid

[11] Patent Number: 5,651,668

[45] Date of Patent: Jul. 29, 1997

[54] APPARATUS FOR THERMALLY CLEANING AN EXHAUST FLUID STREAM

[75] Inventor: Reiner Schmid, Geislingen, Germany

[73] Assignee: Dürr GmbH, Stuttgart, Germany

[21] Appl. No.: 657,639

[22] Filed: May 30, 1996

[30] Foreign Application Priority Data

May 31, 1995 [DE] Germany ..... 195 19 868.9

[51] Int. Cl.[6] ..... F23D 21/00

[52] U.S. Cl. ..... 431/170; 431/5; 431/215; 110/211; 422/175; 422/177; 432/181; 432/209

[58] Field of Search ..... 431/5, 215, 166, 431/170, 11, 326, 328; 432/179–181, 209, 182; 126/91 A; 110/210–212, 233, 235; 165/4, 10, 9.3; 422/170, 175, 206, 177, 171

[56] References Cited

U.S. PATENT DOCUMENTS

| | | | |
|---|---|---|---|
| 3,870,474 | 3/1975 | Houston . | |
| 4,474,118 | 10/1984 | Benedick | 431/5 |
| 4,850,862 | 7/1989 | Bjerklie | 431/170 |
| 5,101,741 | 4/1992 | Gross et al. | 110/233 |
| 5,163,829 | 11/1992 | Wildenberg | 431/170 |
| 5,297,954 | 3/1994 | Colagiovanni | 431/5 |
| 5,460,789 | 10/1995 | Wilhelm | 431/5 |

FOREIGN PATENT DOCUMENTS

| | | |
|---|---|---|
| 29 51 525 | 7/1980 | Germany . |
| 2044901 | 10/1980 | United Kingdom . |

*Primary Examiner*—James C. Yeung
*Attorney, Agent, or Firm*—McAndrews, Held & Malloy, Ltd.

[57] ABSTRACT

An apparatus for thermally cleaning exhaust air containing combustible components comprises at least one combustion chamber for thermally cleaning an exhaust fluid stream and at least two containers adapted for gases to flow therethrough and containing heat storage material for heating the exhaust fluid stream to be cleaned before it enters the combustion chamber and for receiving heat from the cleaned exhaust fluid stream exiting the combustion chamber. Each of the containers has at least one first opening for connecting the container interior to the combustion chamber and at least one second opening for supplying exhaust fluid stream to be cleaned to the container interior and for withdrawing the cleaned exhaust fluid stream from the container interior. The containers accommodating the heat storage substances can be flexibly configured and, if desired, arranged one behind the other in a row. The supplying of the exhaust fluid stream to the containers and the withdrawal of the cleaned exhaust fluid stream from the containers are controlled by two slide valves associated each container, the valve slides of each of these slide valves being synchronously displaceable preferably by a drive which is common to each of the valve slides.

16 Claims, 3 Drawing Sheets

APPARATUS FOR THERMALLY CLEANING AN EXHAUST FLUID STREAM

FIELD OF THE INVENTION

The present invention relates to an apparatus for thermally cleaning an exhaust fluid stream and, more particularly, to an apparatus having combustion chamber and at least two containers adapted for a fluid stream to flow therethrough.

BACKGROUND OF THE INVENTION

In the thermal cleaning of an exhaust fluid stream using regenerative heat exchangers, two or more containers can be employed, each of which contains heat storage material through which the exhaust fluid stream flows. The ends of each container are connected to one another by at least one combustion chamber. The noxious exhaust fluid stream which contains combustible, gaseous or vaporous components such as solvent vapors, and which is typically withdrawn from a production or refining process, first flows through one of the containers, is heated by a previously heated-up heat storage material, and then passes into the combustion chamber in which the noxious components, if necessary, with the addition of a fuel, are oxidized at temperatures of, for example, between 800° and 1,000° C., in particular, to form $CO_2$ and $H_2O$. The thus cleaned, hot exhaust fluid stream (the so-called purified gas) then flows through the other container and heats the heat storage material contained therein. Each of the containers is alternately supplied with an inlet exhaust fluid stream to be cleaned and a purified exhaust fluid stream to be cooled. A flushing operation is usually carried out between these two operations, i.e., the container which has been previously supplied with inlet exhaust fluid stream to be cleaned is flushed with purified gas or fresh air to prevent noxious components in the inlet exhaust fluid stream from being carried into the purified exhaust fluid stream. Alternatively, the noxious gas volume is aspirated from the pertinent container and conducted to the inlet exhaust fluid stream yet to be cleaned.

The exhaust fluid stream employed herein is principally a gaseous stream which contains combustible, gaseous or vaporous components. The exhaust fluid stream may also be a liquid stream which contains combustible, gaseous or vaporous components.

The alternating operation of a container as a device for heating the exhaust fluid stream to be cleaned, as a device to be heated by the hot purified gas, or as a container from which the noxious residual gas is to be removed, is realized in such known apparatus by an inlet flap, an outlet flap and a withdrawal or flushing gas flap or by a rotary slide which assumes the functions of these flaps each being associated with each container.

When flaps are used, considerable driving energy is required for actuation of the flaps, and, in addition, high control component costs. Since the flaps are normally actuated with a compressed fluid stream, they open and close abruptly without any special additional devices and thus cause strong pressure fluctuations in the installation which can have a negative effect on the process preceding the cleaning of the exhaust fluid stream. Also, during the switching of the flaps emission peaks occur in the purified gas (higher proportions of noxious substances) as a result of the brief occurrence of bypass short circuits between exhaust fluid stream to be cleaned which is supplied to the installation and purified gas which is removed from the installation.

The use of a rotary slide requires the containers accommodating the heat storage materials to have circularcylindrical shapes. Such a requirement makes it virtually impossible to use commercially available, ceramic honeycomb bodies (which are block-shaped) for the heat storage materials. Bulk material must therefore be employed as the heat storage material, but this results in a pressure loss which is approximately ten times greater than the pressure loss caused by honeycomb bodies. Such a large pressure drop has a negative effect on the consumption of electric energy for a ventilator with which the exhaust fluid stream to be cleaned is conveyed into the installation.

The object underlying the present invention is to provide an apparatus for thermally cleaning exhaust fluid stream, the basic construction of which enables the apparatus to be readily designed such that with it at least some of the disadvantages of the known apparatus explained hereinabove are avoided.

SUMMARY OF THE INVENTION

These and other objects are achieved by an apparatus for thermally cleaning an exhaust fluid stream containing combustible, gaseous or vaporous components. The apparatus comprises at least one combustion chamber for thermally cleaning an exhaust fluid stream and at least two containers adapted for gases to flow therethrough, each of the containers containing heat storage material for imparting heat to the exhaust fluid stream to be cleaned before the exhaust fluid stream enters the combustion chamber, and for receiving heat from the purified exhaust fluid stream as the purified stream exits the combustion chamber. Each of the containers has at least one first opening for connecting the container interior to the combustion chamber and at least one second opening for supplying exhaust fluid stream to be cleaned to the container interior and for withdrawing purified gas from the container interior, respectively. The openings are located at container ends arranged opposite each other in the direction of the flow through the respective container. The apparatus also comprises an exhaust fluid stream supply conduit, a purified gas discharge conduit and control devices for alternately connecting the second container openings to the exhaust fluid stream supply conduit and the purified gas discharge conduit.

The present apparatus is configured such that at least one first slide valve and at least one second slide valve are provided for each container. Each of the first slide valves communicates, on the one hand, with the exhaust fluid stream supply conduit, and each of the second slide valves communicates, on the one hand, with the purified gas discharge conduit. The first and second slide valves communicate, on the other hand, with the second container openings of the containers associated with the valves. The first slide valves include a first valve slide and the second slide valves include a second valve slide. Drive devices are provided for synchronous displacement of all valve slides and the valve slides are configured and displaceable by the drive devices such that during simultaneous and synchronous displacement of the valve slides of the slide valves associated with the two containers, the first slide valve of one container and the second slide valve of the other container are closed when the second slide valve of the one container and the first slide valve of the other container are at least partly open. Alternately, the second slide valve of the one container and the first slide valve of the other container are closed when the first slide valve of the one container and the second slide valve of the other container are at least partly open.

The present apparatus offers flexibility in the design of the containers accommodating the heat storage materials.

Therefore, if desired, the commercially available, block-shaped, ceramic honeycomb bodies can also be used as heat storage materials. Since the valve slides are to be simultaneously and synchronously displaced, the precondition for use of a drive common to at least several valve slides is provided. This can be, for example, an electric gear motor so the opening and closing of the second container openings do not occur abruptly. Finally, the valve slides can be readily designed such that bypass short circuits between exhaust fluid stream to be cleaned flowing into the apparatus and purified gas flowing out of the apparatus and hence emission peaks in the purified gas leaving the apparatus are avoided. The control component costs for such an apparatus can also be significantly reduced in comparison with the known apparatus in that the valve slides are simultaneously and synchronously displaced.

A further reduction in the cost associated with the actuation of the valves of the present apparatus is achievable by having the first slide valves disposed in a first plane and arranged equidistantly from one another in a first direction, and by having the second slide valves disposed in a second plane and arranged equidistantly from one another in a second direction. In this embodiment, the first slide valves preferably have a first valve slide displaceable in the first plane in the first direction and common to each of the first slide valves, and the second slide valves have a second valve slide displaceable in the second plane in the second direction and common to each of the second slide valves. A maximum of two drives is thus required for the valve slides, namely, a first drive for the first valve slide and a second drive for the second valve slide.

If the first and second valve slides are also displaceable in the same direction, and the containers follow one another in this direction, it is possible for both valve slides to be actuated by a single motor.

The present apparatus could, for example, be designed in the nature of a merry-go-round, i.e., the containers could be arranged along a circle, and the two valve slides would then have the shape of a circular ring or the shape of part of a circular ring and would be moveable around the center of the circle. However, the construction becomes simpler when the containers are arranged so as to follow one another in a straight-line direction, thereby forming a row of containers, and when the valve slides extend in this direction, with, for example, the shape of narrow, elongate rectangles which reciprocate (are pushed back and forth) in their longitudinal direction. It is, of course, also possible to provide the first and second slide valves of each container with a valve slide common to both of these valves which extends transversely to the row of containers and can reciprocate in its longitudinal direction.

The construction becomes even simpler again, in particular, with respect to the valve slide drives or the valve slide drive when the first and/or the second valve slide is formed by a flexible endless belt which comprises at least one opening for each of the first and second slide valves, respectively, and is guided over two deflection rollers arranged such that the one strand of the endless belt extends over the entire row of containers. In this embodiment, only one motor running constantly in the same direction is required to continuously drive at least one of the deflection rollers.

When the first and second planes are identical, it is then even possible to operate the apparatus with a single endless belt and only two deflection rollers.

Valve slides in the form of endless belts driven in the same direction have, in comparison with reciprocating valve slides, not only the advantage that a simpler valve slide drive can be used but also the advantage that a valve slide moved continuously in the same direction is subject to less wear as it is only sliding friction that occurs at the valve slide and static friction need not be overcome.

In principle, it is possible to provide each of the containers with only a single second opening, from which there extends a conduit which branches off between the container and the exhaust fluid stream supply conduit and also the purified gas discharge conduit into two conduits with which a first or a second slide valve, respectively, is associated. With a view to minimizing the emission, it is, however, more expedient for each container to have two second openings, one of which communicates with the first slide valve associated with the pertinent container via a conduit and the other of which communicates with the second slide valve associated with the pertinent container via a conduit.

It is recommended, when working with two endless belts as valve slides, to arrange the first slide valves in the exhaust fluid stream supply conduit and the second slide valves in the purified gas discharge conduit and to design the construction such that each slide valve is adjoined, in the direction towards the container associated with this valve, by a pipe connection which protrudes into the pertinent conduit and is sealed off relative to the conduit wall. For, the valve slides do then not have to cross any conduits or connections, but can either seal off the ends of the pipe connections protruding into the exhaust fluid stream supply conduit and the purified gas discharge conduit, respectively, or release them to allow gas to pass through. In this case, it is recommended that steel belts be used as endless belts, i.e., belts consisting of a thin, flexible sheet steel in which openings are provided for allowing gas to pass through the pipe connections. To ensure tight sealing of these pipe connections in a simple way, a preferred embodiment of the present apparatus is configured such that by means of slide seals provided at the ends of the pipe connections that are adjacent to the valves and by means of pressing and guiding elements that engage the endless belts, the endless belts rest outside their openings sealingly against these pipe connection ends.

In order to avoid the bypass short circuits mentioned hereinabove, the endless belts are designed such that, in a side view of the strands acting as valve slides, in the direction in which the strands run, the openings of one strand do not overlap those of the other strand.

Further features, advantages and details of the invention will be apparent from the following description and the appended drawings of a particularly advantageous embodiment of the present apparatus.

DETAILED DESCRIPTION OF THE PREFERRED EMBODIMENTS

For reasons of simplicity, the inlet exhaust fluid stream which is to be cleaned will be referred to hereinbelow as "contaminated gas", and the exhaust fluid stream which has been cleaned as "purified gas".

Figure 1:
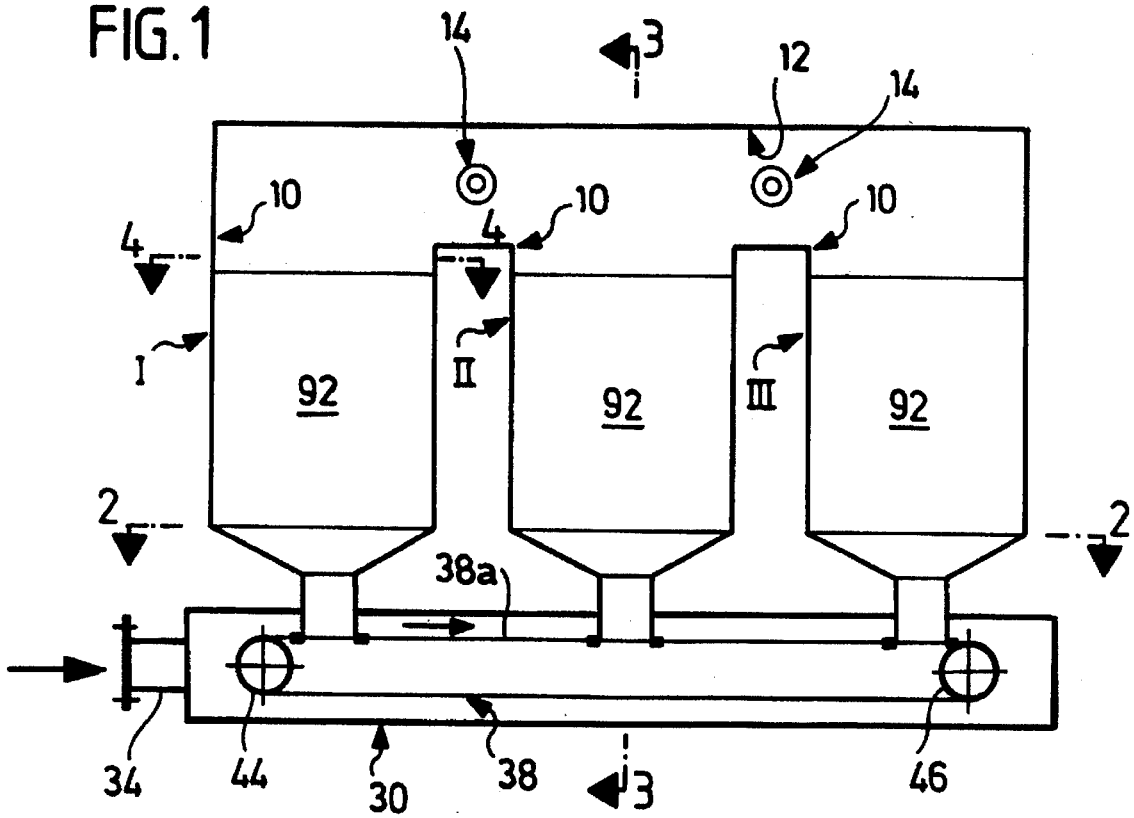
FIG. 1 is a schematic longitudinal sectional view, along a vertical plane, of the exhaust fluid stream cleaning installation, taken in the direction of line 1-1 in FIG. 3.

As shown in FIG. 1, the present installation comprises three containers I, II and III arranged one behind the other in a straight line. In accordance with the invention, each of these has the same and preferably a rectangular cross section (see FIG. 2). Each container comprises a top opening 10, the cross section of which is preferably equal to the cross section of the actual container. Located above the containers is a longitudinal conduit 12 which extends over all three containers and communicates with these through their top openings 10, but is otherwise closed on all sides thereof. Two burners 14 are located in the one side wall 12*a* of the longitudinal conduit 12, more particularly, each in the area of transition between two containers. By means of these burners, which are fed, for example, a combustible gas, the noxious substances contained in the contaminated gas are burned, when the nature and concentration of the noxious substances, also after appropriate heating of the contaminated gas, are not suited for the heated contaminated gas to burn of its own accord in the longitudinal conduit 12. Alternatively, the noxious components of the contaminated gas could also be catalytically oxidized, if they are suited for such catalytic oxidation. In this case, the heat storage substances contained in containers I to III and described hereinbelow should be coated with a suitable catalyst.

Figure 2:
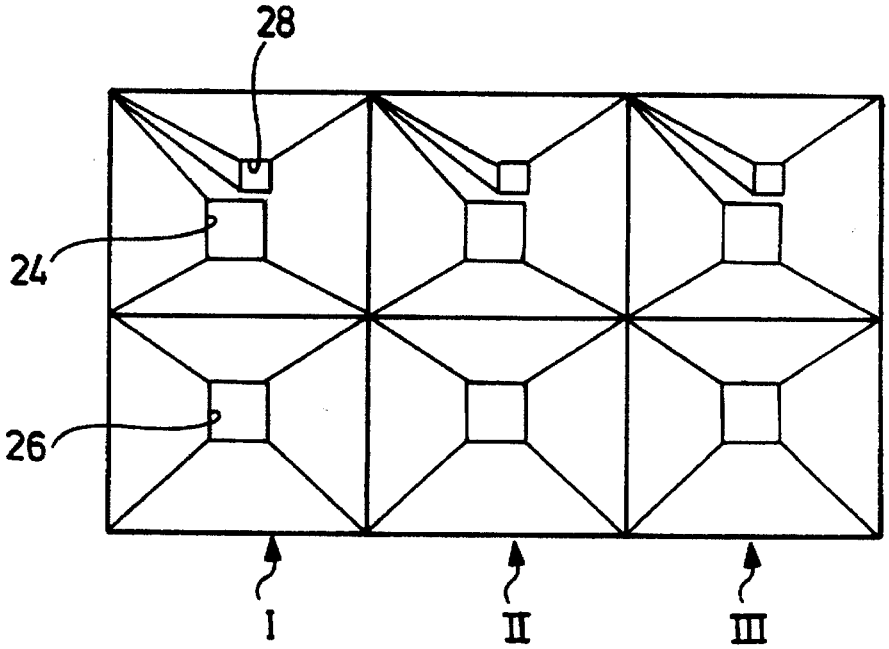
FIG. 2 is a horizontal sectional view, taken in the direction of line 2-2 in FIG. 1, of the containers of the installation, wherein, unlike the illustration in FIG. 1, the three containers of the installation lie immediately adjacent to one another in the longitudinal direction of the installation.
Figure 3:
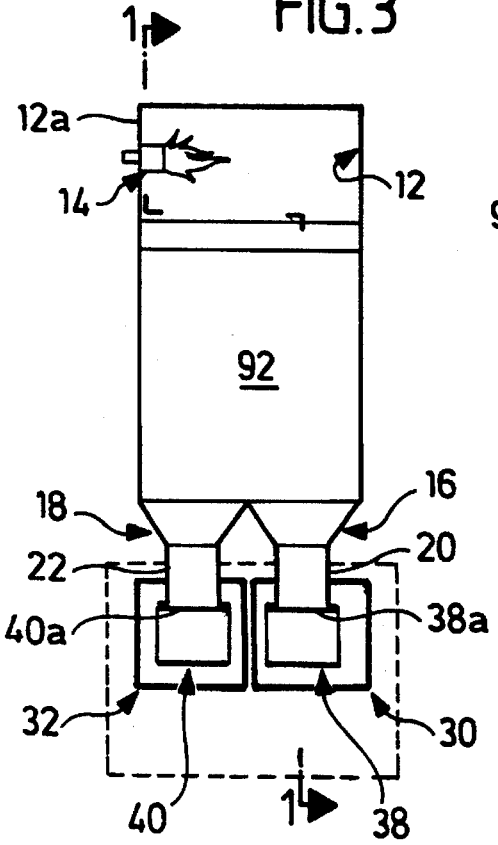
FIG. 3 is a section view of the installation taken in the direction of line 3-3 in FIG. 1.

As is apparent from FIG. 2 in conjunction with FIG. 3, each of the containers I, II and III has at the bottom two funnels tapering downwards, the one component thereof being a contaminated gas inlet conduit 16 and the other component thereof being a purified gas outlet conduit 18. Adjoining these is a pipe connection 20 and 22, respectively, which together with the adjacent funnel forms the respective conduit 16 and 18, respectively. A contaminated gas inlet opening 24 and a purified gas outlet opening 26 belong to each of the containers I, II and III, but as is apparent from FIG. 2, each of the containers also has a flushing fluid stream opening 28 adjacent to the contaminated gas inlet opening 24.

The pipe connections 20 of the contaminated gas inlet conduits 16 protrude into a contaminated gas conduit 30 and are guided tightly through the wall of this conduit. In the same way, the pipe connections 22 of the purified gas outlet conduits 18 protrude into a purified gas conduit 32. It is advantageous for the pipe connections 20 and 22 to all terminate in the same horizontal plane, and, in the preferred embodiment, the bottom opening cross sections of the pipe connections 20 and 22 are square and the same size, as is also the case with the flow cross sections of the conduits 16 and 18 at other locations. As is apparent from FIG. 1, the contaminated gas conduit 30 has the shape of a hollow, elongate, right parallelepiped, which is closed at both end faces thereof except for a contaminated gas connection 34. As indicated by an arrow in FIG. 1, the contaminated gas which is to be cleaned is fed to the contaminated gas conduit 30 through the connection 34. The same applies accordingly to the purified gas conduit 32 which is provided with a connection, not illustrated, for withdrawal of the purified gas. It is advantageous for contaminated gas conduit 30 and purified gas conduit 32 to have the same dimensions and to lie at the same level.

Associated with all contaminated gas inlet conduits 16 is a first endless belt 38 which is common to these, and associated with all purified gas outlet conduits 18 is a second endless belt 40. These two endless belts should be flexible belts, but impermeable to gas throughout their cross section. The belts are preferably made of thin stainless steel, and at least the outwardly pointing main surfaces of the two endless belts should be absolutely smooth. The endless belt 38 running in the contaminated gas conduit 30 is guided over a front and a rear deflection roller 44 and 46, respectively. The deflection rollers 44 and 46 are mounted in the contaminated gas conduit 30 for rotation about horizontal axes extending parallel to one another, and of these, the front roller 44, for example, is driven by a motor 50 illustrated in FIG. 5. The top strand 38*a* of the endless belt 38 rests against the bottom ends of the pipe connections 20, as will be explained in further detail hereinbelow with reference to FIG. 6.

Similarly, the second endless belt 40 running in the purified gas conduit 32 and to its top strand 40*a* rests against the bottom ends of the pipe connections 22. As indicated in FIG., 5, both endless belts 38 and 40 are preferably driven by a single motor, more particularly, synchronously, at the same running speed and in the same direction, e.g., in the direction of the arrows indicated in FIGS. 1 and 8. Such a common drive only requires the shaft 50*a* of the motor 50, indicated by a dashed line in FIG. 5, to be guided in a gas-tight manner through the walls of the purified gas conduit 32 and the contaminated gas conduit 30. For reasons of simplicity, the mountings of the two deflection rollers 44 and 46 have been omitted.

Figure 5:
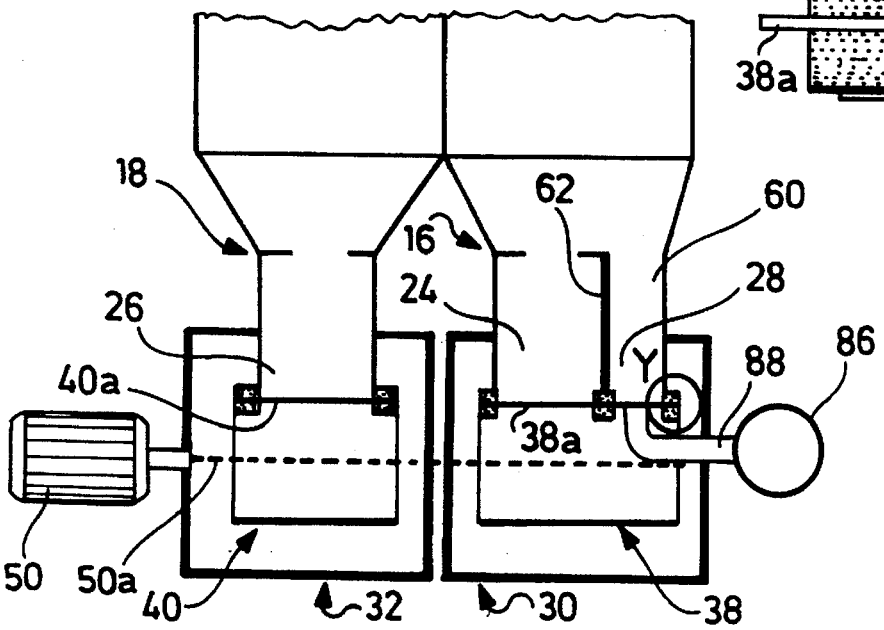
FIG. 5 is an enlarged version of the bottom portion of the sectional illustration shown in FIG. 3, and in which additional components of the installation are illustrated.

As is apparent from FIG. 5, there is integrated into each of the contaminated gas inlet conduits 16 a flushing fluid stream conduit 60, the bottom end of which forms the flushing fluid stream opening 28 shown in FIG. 2. The flushing fluid stream conduit 60 is separated over part of the length of the contaminated gas inlet conduit 16, more particularly, from the bottom upwards, from the flow path of the contaminated gas flowing into the pertinent container by a partition wall 62.

The top strand 38*a* and 40*a*, respectively, of each of the endless belts 38, 40 is guided at the bottom end of the pipe connection 20 and 22, respectively, in slide guides such that the pertinent endless belt seals off the associated pipe connection at the bottom, unless an opening in the endless belt is just passing the pipe connection (this will be explained in further detail hereinbelow). Of course, the same applies accordingly to the flushing fluid stream conduit 60 and the top strand 38*a* of the first endless belt 38.

Figure 6:
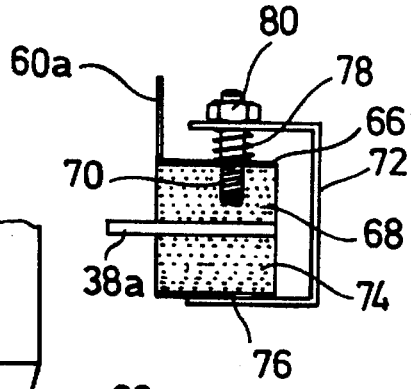
FIG. 6 is enlarged view of section "Y" of FIG. 5.

The way in which the belts are guided and the sealing is effected will now be explained with reference to FIG. 6. A sheet metal support 66 is attached, e.g., welded to the bottom end of a wall of the pertinent pipe connection, in the section illustrated in FIG. 6 at the bottom end of a wall 60*a* of the pipe connection forming the flushing fluid stream conduit 60. A first seal 68 is attached, for example, adhesively bonded, to the underside of the sheet metal support 66. The seal consists of such a material that it results in relatively low sliding friction between seal and pertinent endless belt, but in good gas impermeability. Attached to the sheet metal support 66, one behind the other, in the direction perpendicular to the drawing plane of FIG. 6, are several threaded bolts 70. These hold and extend through a clamping bracket 72. Attached to this clamping bracket is a second seal 74 corresponding to the seal 68, together with its associated sheet metal support 76. The seals 68 and 74 enclose between them a longitudinal edge area of the top strand (here the top strand 38*a*) of the pertinent endless belt. Each threaded bolt 70 extends through a pressure spring 78 arranged between sheet metal support 66 and clamping bracket 72. The top leg of the clamping bracket 72 is arranged so as to be vertically displaceable on the threaded bolt between the top end of the pressure spring 78 and a nut 80 screwed onto the threaded bolt 70. The pressure spring 78 thus permits the top strand of the pertinent endless belt to slide between the seals 68 and 74, and also to rest with the necessary sealing forces against the endless belt. A similar structure applies to the four other sealing and guiding locations illustrated in FIG. 5.

Finally, FIG. 5 shows a flushing fluid stream conduit 86 running along the row of containers. Branching off from the flushing fluid stream conduit 86 for each of the containers I, II and III is a branch pipe 88 which is guided in a gas-tight manner through the wall of the contaminated gas conduit 30 and terminates at the underside of the top strand 38*a* of the endless belt 38. It is expedient for this end of the branch pipe 88 to be provided with a ring-shaped slide seal against which the top strand 38*a* rests with slight pressure. In the illustrated embodiment, fresh air is to be fed to the flushing fluid stream conduit 86, for example, via a fan, more particularly, in such a way that a certain excess pressure is constantly maintained in the flushing fluid stream conduit 86 (in comparison with the gas pressure within the containers I, II and III).

Figure 7:
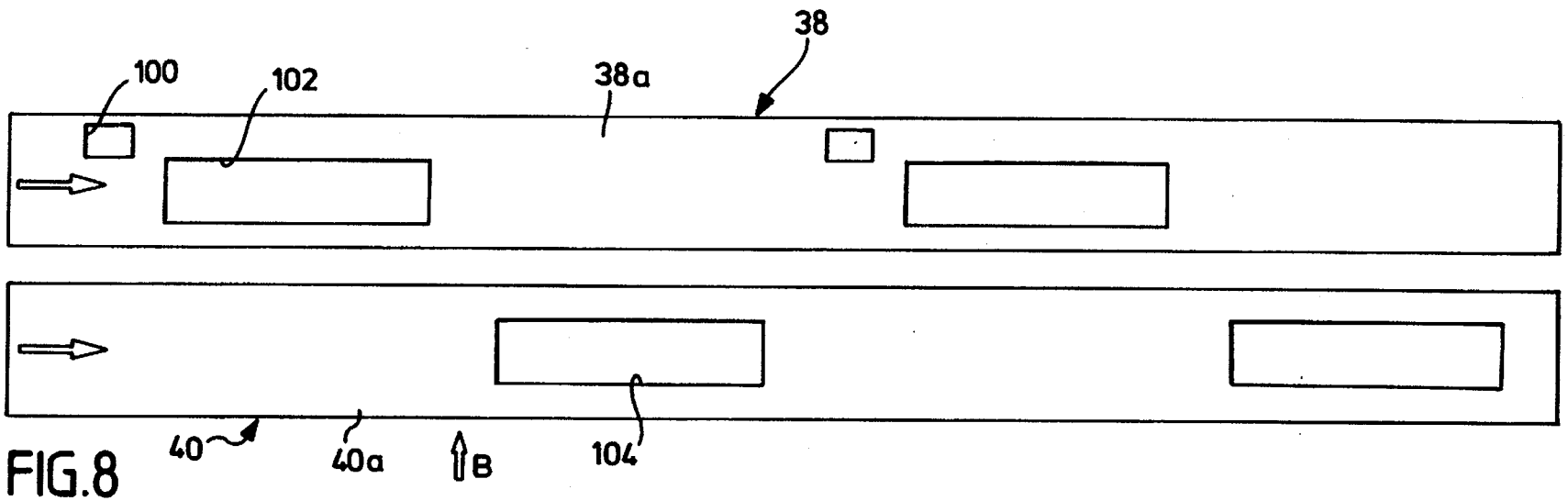
FIG. 7 is a plan view of a portion of the top strands of the endless belts of the installation which form the two valve slides.
Figure 8:
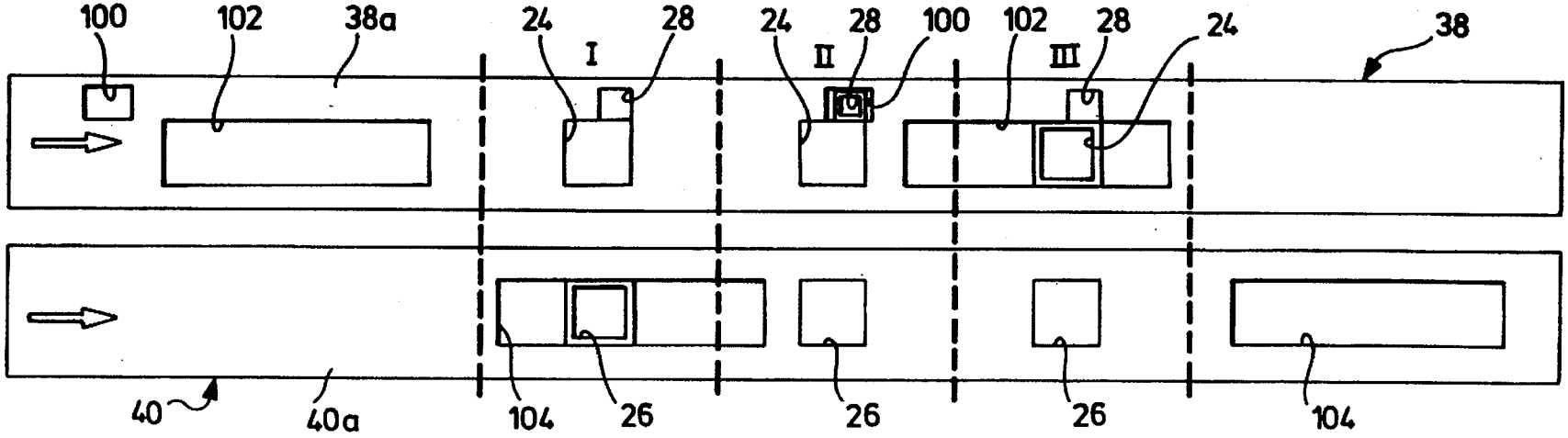
FIG. 8 is a view corresponding to FIG. 7, but in which the bottom openings of the three containers of the installation are drawn in a vertical projection onto the endless belts.

As shown in FIGS. 7 and 8, the steel belts forming the endless belts 38 and 40 are perforated in a periodically repeating manner, i.e., are provided with through-openings for the gas. Within each longitudinal section forming a period, the endless belt 38 has a through-opening 100 for the flushing fluid stream and a through-opening 102 for the contaminated gas (following each other in the running direction), while the endless belt 40 has only a single opening, namely a through-opening 104 for the purified gas, within each longitudinal section forming such a period. Viewed transversely to the longitudinal direction or the running direction of the belt, i.e., viewed in the direction of arrow B in FIG. 7, the two openings 100 and 102 are closely adjacent to each other, but the openings are arranged in the two endless belts 38 and 40 such that, viewed in the direction of arrow B, the belts do not overlap each other, particularly when the two endless belts 38 and 40 are mounted relative to each other in the correct phase on their deflection rollers 44, 46.

Figure 4:
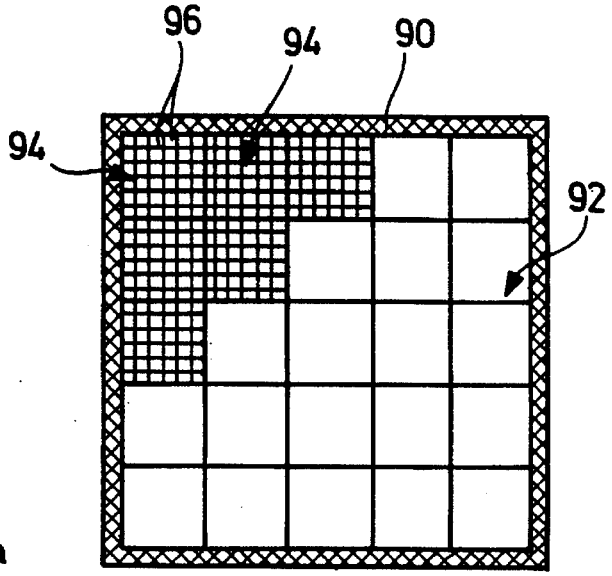
FIG. 4 is a sectional view of the first container of the installation taken in the direction of line 4-4 in FIG. 1.

As is apparent from FIG. 4, each of the containers I, II and III accommodates within a circumferential wall 90 which defines a rectangular, in particular, square cross section, and is provided with thermal insulation, a heat storage substance denoted in its entirety by 92 (see also, e.g., FIGS. 1 and 3). The heat storage substance is comprised of commercially available, block-shaped, ceramic honeycomb bodies 94, each of which comprises a plurality of flow conduits 96 extending in the vertical direction. The heat storage substance 92 contained in the pertinent container I or II or III is comprised of several layers of honeycomb bodies 94 layered one on top of the other, and, in the illustrated embodiment each layer is formed by 25 honeycomb bodies 94 of identical design. The flow conduits 96 of each honeycomb body 94 are in alignment with the flow conduits of the honeycomb bodies arranged above and below this honeycomb body, which results in a large number of vertical flow conduits and, consequently, in a relatively low pressure loss in each container I, II and III.

The operation of the present installation will now be explained in further detail with reference to FIGS. 1 and 8. In FIG. 8, not only the inlet openings 24 for the contaminated gas, the outlet openings 26 for the purified gas and the openings 28 for the flushing fluid stream of the three containers I, II and III are drawn, but, in addition, those sections in which the three containers I, II and III lie are indicated by dashed lines running transversely to the two endless belts and by the reference numerals I, II and III. As mentioned hereinabove, the top strands 38*a* and 40*a* of the two endless belts 38 and 40 are to move in the direction of the arrows indicated in FIG. 8, more particularly, at the same speed and in the phase position of the two belts relative to each other indicated in FIG. 8.

In the description of the operation, the description of that state which is illustrated in FIG. 8 will serve as starting point. When the installation is in this state, contaminated gas fed to the contaminated gas conduit 30 flows through the contaminated gas through-opening 102 shown on the right in FIG. 8 from the bottom into container III, more particularly, through its contaminated gas inlet opening 24. As will be apparent from the following, the heat storage substance 92 of container III is at a relatively high temperature in this state, and so it heats the contaminated gas flowing through the heat storage substance from the bottom to the top. The contaminated gas then passes through the top container opening 10 into the longitudinal conduit 12 forming a combustion chamber and is subsequently thermally cleaned in the longitudinal conduit 12, in particular, as it flows past the burner 14 shown on the right in FIG. 1.

The thus obtained purified gas free from noxious substances flows in accordance with FIG. 1 from the right to the left through the longitudinal conduit 12 and from the top into container I through its top opening 10. As it flows through the heat storage substance 92 contained in container I from the top to the bottom, the hot purified gas gives off heat to this heat storage substance and thereby heats it up before the purified gas leaves container I through the purified gas outlet opening 26, crosses the top strand 40*a* of the endless belt 40 through the purified gas through-opening 104 shown on the left in FIG. 8 and flows into the purified gas conduit 32.

As the through-openings 102 and 104 are of relatively long design in the running direction of the endless belts, the procedure described hereinabove takes a correspondingly long time (depending, of course, on the running speed of the endless belts). During this procedure, the endless belt 38 releases the flushing fluid stream opening 28 of container II quite briefly, in particular, by means of the flushing fluid stream through-opening 100 shown on the right in FIG. 8. During that time interval in which the flushing fluid stream opening 28 of container II is released, a flushing fluid stream, typically air, is urged out of the flushing fluid stream conduit 86 through the branch pipe 88 belonging to container II into container II, flows through the latter from the bottom to the top, takes residual contaminated gas which has remained in container II along with it to the top and then flows into the longitudinal conduit 12 where this residual contaminated gas undergoes combustion by the burner 14 located downstream. Alternatively, the residual contaminated gas could be aspirated out of container II through conduit 86 and fed to the contaminated gas which has still to be cleaned. A further alternative consists in flushing container II from the top to the bottom, in particular, with purified gas which has been obtained from the contaminated gas which has flowed through container III from the bottom to the top. In this case, too, the flushing gas carrying noxious substances should then be fed again to the contaminated gas which has still to be cleaned.

Since the top strand 38*a* of the first endless belt and the top strand 40*a* of the second endless belt according to FIG. 8 move continuously to the right, the flushing fluid stream opening 28 of container II is first closed and the purified gas outlet opening 26 of container II is slowly released by the purified gas through-opening 104 shown on the left in FIG. 8. The purified gas outlet opening 26 of container I is then closed, while the purified gas outlet opening 26 of container II still remains open for quite a long time. So long as the purified gas outlet opening 26 of container II is open, the contaminated gas inlet opening 24 of container III is first slowly closed and simultaneously the contaminated gas inlet opening 24 of container I slowly opened—when the latter is completely open, the contaminated gas inlet opening 24 of container III is completely closed. For a certain time, thermally cleaned gas coming from containers I and III then flows off as purified gas via container II, and this is followed by a phase in which the contaminated gas which is to be thermally cleaned only comes from container I and the purified gas flows off via container II. Immediately after closure of the contaminated gas inlet opening 24 of container III, its flushing fluid stream opening 28 is briefly released to flush container III. So long as the contaminated gas inlet opening 24 of container I is open, the purified gas outlet opening 26 of container II is slowly closed and simultaneously the purified gas outlet opening 26 of container III is slowly released. Finally, the purified gas outlet opening 26 of container II is closed and the contaminated gas inlet opening 24 of container II is slowly released, while the contaminated gas inlet opening 24 of container I is slowly closed. While the contaminated gas inlet opening 24 of container II and the purified gas outlet opening 26 of container III are open, container I is flushed by its flushing fluid stream opening 28 being briefly released. The purified gas outlet opening 26 of container III is then slowly closed and simultaneously the purified gas outlet opening 26 of container I is slowly released. After closure of the purified gas outlet opening 26 of container III, the contaminated gas inlet opening 24 of container III is slowly released and simultaneously the contaminated gas inlet opening 24 of container II is slowly closed, whereupon the procedure commences anew.

Accordingly, in the present installation, contaminated gas to be cleaned is constantly heated so long as it flows through one of containers I, II and III and hence through the previously heated up heat storage substance 92 contained therein from the bottom to the top. The thermal cleaning of the gas is then carried out in the longitudinal conduit 12, whereupon it flows through another one of the containers I, II and III and hence through the heat storage substance 92 contained therein from the top to the bottom, while doing so gives off part of its heat and heats up this heat storage substance. The containers are subsequently switched over so that the contaminated gas to be cleaned flows through the previously heated container from the bottom to the top and is thereby heated.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. Apparatus for thermally cleaning an exhaust fluid stream containing combustible, gaseous or vaporous components, the apparatus comprising at least one combustion chamber for thermally cleaning an exhaust fluid stream and at least two containers adapted for a fluid stream to flow therethrough, each of said containers containing heat storage material for imparting heat to said exhaust fluid stream to be cleaned before said stream enters said combustion chamber and for receiving heat from said exhaust fluid stream exiting said combustion chamber, each of said containers having at least one first opening formed therein for connecting the interior of each of said containers to said combustion chamber and at least one second opening formed therein for alternately supplying said exhaust fluid stream to be cleaned to said container interior and withdrawing said cleaned exhaust fluid stream from said container interior, said openings being located at opposite container ends in the direction of the flow through the respective container, the apparatus further comprising an exhaust fluid stream supply conduit, a cleaned exhaust fluid stream discharge conduit, and control devices for alternately communicating said second container openings with said exhaust fluid stream supply conduit and said cleaned exhaust fluid stream discharge conduit, each of said containers having at least one first slide valve and at least one second slide valve associated therewith, each of said first slide valves communicating, on the one hand, with said exhaust fluid stream supply conduit and each of said second slide valves communicating, on the one hand, with said cleaned exhaust fluid stream discharge conduit, said first and second slide valves communicating, on the other hand, with said second container openings, each of said first slide valves including a first valve slide and each of said second slide valves including a second valve slide, each of said valve slides synchronously displaceable such that during simultaneous and synchronous displacement of said valve slides, said first slide valve of a first one of said containers and said second slide valve of a second one of said containers are closed when said second slide valve of said first container and said first slide valve of said second container are at least partly open, and said second slide valve of said first container and said first slide valve of said second container are closed when said first slide valve of said first container and said second slide valve of said second container are at least partly open.

2. The apparatus of claim 1 wherein all of said first slide valves are disposed in a first plane and are arranged equidistantly from one another in a first direction, and wherein all of said second slide valves are disposed in a second plane and are arranged equidistantly from one another in a second direction, and wherein each of said first slide valves has a first valve slide displaceable in said first plane in said first direction and common to each of said first slide valves, and each of said second slide valves has a second valve slide displaceable in said second plane in said second direction and common to each of said second slide valves.

3. The apparatus of claim 2 wherein said first and said second directions are identical, and said containers are arranged one after the other in said same direction.

4. The apparatus of claim 3 wherein said containers are arranged one after the other in a straight-line direction, thereby forming a row of containers, said valve slides extend in said straight-line direction.

5. The apparatus of claim 4 wherein said first valve slide is formed by a flexible endless belt which comprises for each of said first slide valves at least one opening formed therein, said belt being guided over at least two deflection rollers arranged such that the one strand of said belt extends over the entire row of said containers.

6. The apparatus of any of claims 4 or 5 wherein said second valve slide is formed by a flexible endless belt which comprises for each of said second slide valves at least one opening formed therein, said belt being guided over at least two deflection rollers arranged such that the one strand of said belt extends over the entire row of said containers.

7. The apparatus of claim 2 wherein said first and said second planes are identical.

8. The apparatus of claim 1 wherein each of said valve slides is displaced by a single common motor.

9. The apparatus of claim 4, wherein said first and second planes are identical, wherein said first valve slide is formed by a first flexible endless belt which comprises for each of said first slide valves at least one opening formed in said first belt, wherein said second valve slide is formed by a second flexible endless belt which comprises for each of said second slide valves at least one opening formed in said second belt, said first and second belts being guided over at least two deflection rollers common to both of said belts and arranged such that one strand of each of said belts extends over the entire row of said containers, and wherein a single motor is provided for displacing said first belt and said second belt.

10. The apparatus of claim 1 wherein each container has two second openings formed therein, one of said second openings communicating with said first slide valve through a first conduit, the other of said second openings communicating with said second slide valve through a second conduit.

11. The apparatus of claim 1 wherein said first slide valves are arranged in said exhaust fluid stream supply conduit and said second slide valves are disposed in said purified gas discharge conduit, and wherein each slide valve is adjoined, in the direction towards the container associated with said valve, by a pipe connection which protrudes into the respective conduit and is sealed off relative to the conduit wall.

12. The apparatus of claim 4, wherein said first slide valves are arranged in said exhaust fluid stream supply conduit and said second slide valves are disposed in said purified gas discharge conduit, wherein each slide valve is adjoined, in the direction towards the container associated with said valve, by a pipe connection which protrudes into the respective conduit and is sealed off relative to the conduit wall, wherein said first valve slide is formed by a first flexible endless belt which comprises for each of said first slide valves at least one opening formed therein, said first belt being guided over at least two deflection rollers arranged such that one strand of said first belt extends over the entire row of said containers, wherein said second valve slide is formed by a second flexible endless belt which comprises for each of said second slide valves at least one opening formed therein, said second belt being guided over at least two deflection rollers arranged such that one strand of said second belt extends over the entire row of said containers, wherein slide seals are provided at the ends of said pipe connections adjacent to said valves, and wherein pressing and guiding elements engage said first and second endless belts, said endless belts sealing said pipe connections outside their openings.

13. The apparatus of claim 4, wherein said first valve slide is formed by a first flexible endless belt which comprises for each of said first slide valves at least one opening formed therein, said first belt being guided over at least two deflection rollers arranged such that one strand of said first belt extends over the entire row of said containers, wherein said second valve slide is formed by a second flexible endless belt which comprises for each of said second slide valves at least one opening formed therein, said second belt being guided over at least two deflection rollers arranged such that one strand of said second belt extends over the entire row of said containers, and wherein, in a side view of said strands acting as valve slides, in the direction in which said strands run, the openings of said one strand serving to supply said exhaust fluid stream to be cleaned and to withdraw said cleaned fluid stream, respectively, do not overlap those of said other strand.

14. The apparatus of claim 13 wherein, in a side view of said strands acting as valve slides, in the direction in which said strands run, spaces are provided between the openings of said one strand and the openings of said other strand.

15. The apparatus of claim 1 wherein said containers have, in a section taken perpendicular to the direction of the flow through the respective container, a rectangular cross section.

16. The apparatus of claim 15 wherein said heat storage material is formed by block-shaped, ceramic, honeycomb bodies disposed in said containers, said bodies having openings formed therein extending in the direction of the flow through the respective container.

* * * * *